United States Patent [19]

Arita

[11] Patent Number: 4,945,330

[45] Date of Patent: Jul. 31, 1990

[54] ACTUATOR

[75] Inventor: Yoji Arita, Yokohama, Japan

[73] Assignee: Mitsubuishi Kasei, Tokyo, Japan

[21] Appl. No.: 329,321

[22] Filed: Mar. 27, 1989

[30] Foreign Application Priority Data

Mar. 28, 1988 [JP] Japan ..... 63-71928
Oct. 15, 1988 [JP] Japan ..... 63-258364

[51] Int. Cl.[5] ..... H01F 7/08

[52] U.S. Cl. ..... 335/229; 335/272; 310/154

[58] Field of Search ..... 335/229, 230, 272, 279; 310/46, 154

[56] References Cited

U.S. PATENT DOCUMENTS 3,500,090 3/1970 Baermann ..... 310/154
3,970,980 7/1976 Nelson ..... 335/272 X
4,794,291 12/1988 Abukawa et al. ..... 310/154
4,823,037 4/1989 Abukawa et al. ..... 310/154 X

*Primary Examiner*—George Harris

[57] ABSTRACT

An actuator is disclosed, in which an movable armature and a permanent magnet mounted on a stationary yoke are disposed to face each other with a small gap. The armature has at least one pair of protruding poles which are movable along a predetermined path. The permanent magnet comprises plural pairs of juxtaposed magnetic pieces whose polarities are opposite to each other. The plural pairs of magnetic pieces are arranged in juxtaposition with each other at positions adjacent to the path of the corresponding protruding pole so that adjacent two magnetic pieces of adjacent two pairs have the same polarity with each other. The permanent magnet generates such a magnetic pattern that the amount thereof gradually decreases from both ends of the path of each protruding pole towards the boundary of the magnet pieces of the corresponding pair to avoid the influences due to the reluctance torque and the drive torque.

12 Claims, 6 Drawing Sheets

ACTUATOR

BACKGROUND OF THE INVENTION

1. Field of the Invention

The present invention relates to an actuator and, more particularly, to an actuator for precise and high-speed movement, which is suitably applicable to the seeking system for the recording/reproducing head of an opto-magnetic recording apparatus, a hard disc drive apparatus, etc.

2. Related Art

One prior art actuator of a voice-coil type is shown in FIG. 12, which essentially comprises a yoke 1 formed in a shape of rectangular frame, a permanent magnet 2 mounted to the inner wall of one side 1*a* of the yoke 1 and a moving coil 3 wound around the opposite side 1*b* of the yoke 1. Magnetic flux generated from the permanent magnet 2 enters in the side 1*b* to form a magnetic field within the space between the permanent magnet 2 and the side 1*b* of the Yoke 1. When the coil 3 is supplied with energizing current, it moves along the side 1*b* due to the electromagnetic force by the magnetic field. In this case, the moving direction of the coil 3 is determined by the flowing direction of the energizing current.

However, in the actuator of such structure, since the coil 3 exists between the permanent magnet 2 and the side 1*b* of the Yoke 1, a considerably large gap must be formed between them, which lowers the operating point of the permanent magnet 2. In other words, the flux density generated from the permanent magnet 2 becomes small for the energy product of the permanent magnet 2, so that the efficiency of the actuator is lowered. For that, it has been adopted a method of flowing a large current in the coil 3 in order to obtain a driving force having a desired magnitude. However, this method has disadvantages that the large energizing current often the generation of a large amount of heat by the Joule effect, which, in turn, causes differences in thermal expansion among respective parts in the apparatus. As a result, the read-out of the recorded data is impossible in some cases.

SUMMARY OF THE INVENTION

Accordingly, it is an object of the present invention to eliminate the above-mentioned drawbacks and provide an actuator having a simple strucure, which yields a high efficiency and economizes in power.

It is another object of the present invention to provide an actuator capable of effecting a smooth operation by minimizing the variations in reluctance torque and drive torque.

It is still, a further object of the present invention to provide an actuator which is suitable for a precise and high-speed movement.

In order to achieve the above objects, the actuator according to the present invention comprises an armature having at least one pair of protruding poles and movable so that each of said protruding poles is movable along a predetermined path; a coil disposed to surround each of said protruding poles and adapted for energizing same such that said protruding poles are energized in opposite polarities to each other; a stationary yoke extending in the direction parallel to said path; and a permanent magnet composed of plural pairs of juxtaposed magnetic pieces whose magnetic polarities are opposite to each other, said plural pairs of magnetic pieces corresponding in number to the number of said protruding poles and mounted on said yoke in juxtaposition with each other at positions adjacent to the path of the corresponding protruding pole, adjacent two magnetic pieces of adjacent pairs having the same polarity with each other, and said permanent magnet generating such a magnetic flux pattern that the amount thereof gradually decreases from both ends of the path of each protruding pole towards the boundary of the magnetic pieces of the corresponding pair.

DETAILED DESCRIPTION OF THE PREFERRED EMBODIMENTS

Figure 1:
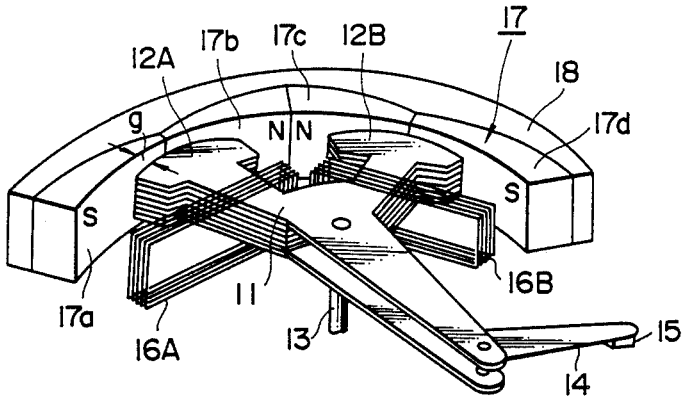
FIG. 1 view showing one example of the actuator according to the present invention.
Figure 2:
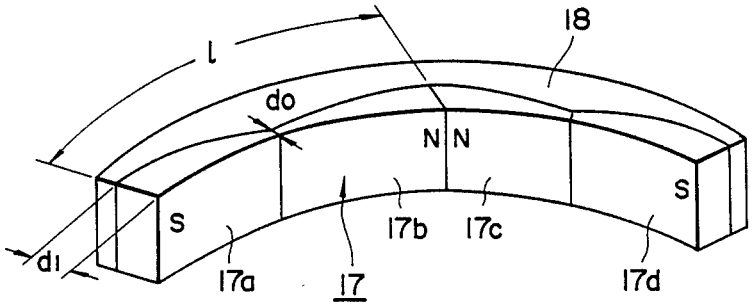
FIG. 2 is a perspective view sharing the permanent magnet and the yoke in the example of FIG. 1.

FIG. 1 is a perspective view schematically illustrating an example of the actuator according to the present invention, in which reference numeral 11 represents a movable armature which is rotatable about an axis 13. The armature 11 is made of a soft magnetic material such as soft-iron and formed in a laminated structure. At one side of the armature 11 are provided two protruding poles 12A and 12B, and at the other side of the same is attached a magnetic head or heads 15 through gimbals 14. The top ends of the two protruding poles 12A and 12B extend a predetermined length in the peripheral direction. Coils 16A and 16B are disposed fixedly and separately from the armature 11, respectively, so as to surround the body portions of the protruding poles 12A and 12B. Namely, the coils 16A and 16B are so designed that the body portions of the protruding poles 12A and 12B can rotate within the spaces defined inside the coils 16A and 16B, respectively.

A permanent magnet 17 composed of four magnet pieces 17*a* to 17*d*, respective magnetic poles of which are magnetized uniformly, is arranged in the form of a circular arc to face the protruding poles 12A and 12B of the armature 11, with a gap g. The magnet pieces 17*a* and 17*b* which are disposed to correspond to the protruding pole 12A are magnetized so that their magnetic poles facing the armature 11 become S-pole and N-pole, respectively. The magnetic pieces 17*c* and 17*d* which are disposed to correspond to the protruding pole 12B are magnetized so that their magnetic poles facing the armature 11 become N-pole and S-pole, respectively.

The thickness of the permanent magnet 17 is at its minimum at the boundary between S-pole (17*a*, 17*d*) and N-pole (17*b*, 17*c*) facing the armature 11 and becomes gradually thicker towards both ends of a movable range 1 of the center portion of the protruding pole 12A or 12B. If the thickness at the boundary is $d_0$ and the thickness at both ends of the movable range 1 is $d_1$, the ratio ($d_0/d_1$) preferably ranges from 0.5 to 0.9. With such configuration, the amount of flux generated from the permanent magnet 17 gradually decreases from both ends of the movable range 1 towards the boundary between S-pole and N-pole, minimizing the variations of the reluctance torque and the drive torque at both ends of the movable range 1. It is preferable that the peripheral length of each of the magnet pieces 17*a*, 17*b*, 17*c* and 17*d* is between 0 to 20% longer than that of the top end of the protruding pole 12A or 12B. It is also preferable that the angle between the two protruding poles 12A and 12B is substantially equal to the rotatable angle of the armature 11. On the rear side of the permanent magnet 17, a yoke 18 is disposed so that the total thickness of the permanent magnet 1 and the yoke 18 is uniform.

The operation of the actuator of FIG. 1 is as follows.

It is assumed that the armature 11 now rests at the origin which is defined as a position where the peripheral positions of the center portions of the protruding poles 12A and 12B coincide with those of the boundaries between N-pole and S-pole of the magnetic pieces 17*a*–17*d*. In order to rotate the armature 11 in the counter-clockwise direction from the origin, energizing currents of the same magnitude but of opposite directions are supplied in the coils 16A and 16B, thus energizing the protruding poles 12A and 12B into N-pole and S-pole, respectively. Then, the protruding pole 12A (N-pole) experiences a repulsive force by N-pole of the magnet piece 17*b* as well as an attractive force by S-pole of the magnet piece 17*a*, while the protruding pole 12B (S-pole) experiences a repulsive force by S-pole of the magnet piece 17*d* as well as an attractive force by N-pole of the magnet piece 17*c*, whereby producing a rotational drive torque, which acts on the armature 11 to rotate it in the counter-clockwise direction. By this rotational movement, the positional control of the magnetic head 15 attached to the armature 11 through the jim-bals 14 can be effected. In this case, the amount of the rotational movement depends upon the magnitude of the energizing current flowing in the coils 16A and 16B and upon the energizing time.

Although the operation has been described as to the case where the armature 11 is rotated in the counter -clockwise direction, the armature 11 can be rotated in the clockwise direction by changing the flowing direction of the energizing current through the coils 16A and 16B. In both cases, the rotational movement of the armature 11 is restricted within the movable range 1.

Figure 3:
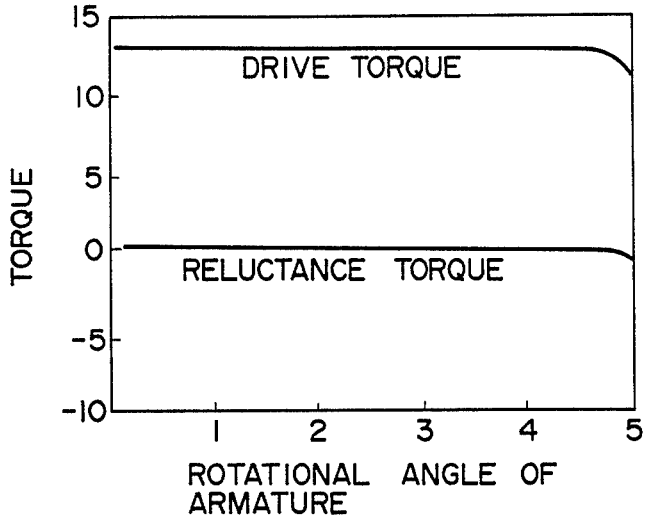
FIG. 3 is a graph showing the relationship between the torque (drive torque and reluctance torque) and the rotational angle the armature shown in the example of FIG. 1.
Figure 4:
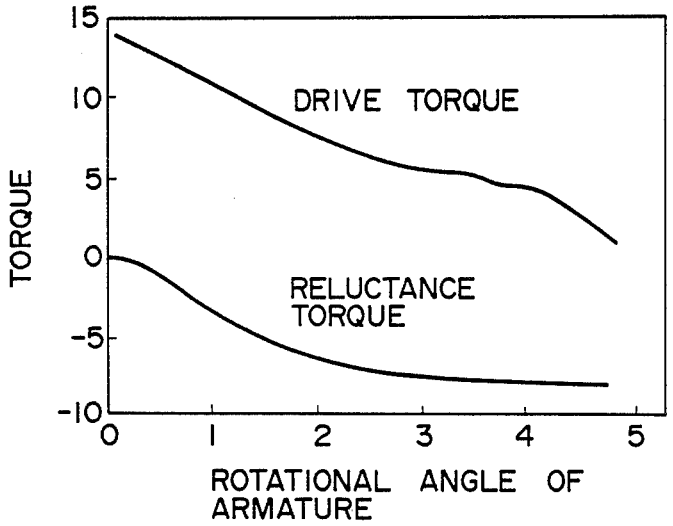
FIG. 4 is a graph showing the relationship between the torque (drive torque and reluctance torque) and the rotational angle of the armature in the actuator having the same structure as in FIG. 1 except that the thickness is uniform throughout its peripheral length.

FIG. 3 is a graph showing the drive torque at the energized state of the coils 16A and 16B and the reluctance torque at the non-energized state with respect to each rotational position of the armature 11, in the actuator of FIG. 1. For comparison, the same relationship is shown in FIG. 4 for the actuator having same structure as in FIG. 1 except that the thickness of the permanent magnet is uniform throughout its peripheral length.

For the actuator of the present invention, it can be seen from FIG. 3 that the reluctance torque is almost negligible enough not to produce a torque ripple and that the drive torque is substantially uniform. On the contrary, for the latter actuator, as seen from FIG. 4, the torque ripple arises due to the generation of the reluctance torque of relatively large value and the drive torque is not uniform over the movable range 1 and varies with the rotational position of the armature 11. In this case, the armature 11 is most stable at the origin.

According to the actuator of FIG. 1, since the armature 11 is used as the moving member, the gap between the permanent magnet 17 and the armature 11 may be largely reduced. Consequently, the operating point of the permanent magnet 17 becomes high to obtain a high flux density, which enables the realization of the actuator with high efficiency.

Moreover, the coils 16A and 16B are disposed fixedly and separately from the protruding poles 12A and 12B of the armature 11 and only the armature 11 is used as the moving member, the mass of the actuator can be reduced and the access time can be shortened.

Figure 5:
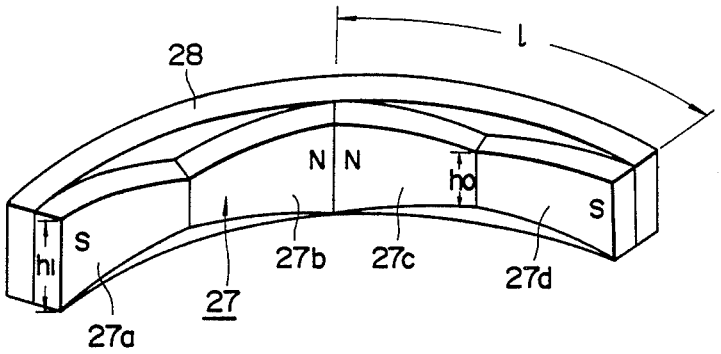
FIGS. 5 to 9 each is a perspective view showing the permanent and Yoke of other examples of the actuator according to the present invention.

FIG. 5 shows another example having substantially the same structure as in FIG. 1 except that the vertical length of the permanent magnet 27 is at its minimum at the boundary between N-pole (27*b*, 27*c*) and S-pole (27*a*, 27*d*) facing the armature 11 and gradually increases towards both ends of the movable region 1. The armature 11 is omitted in the drawings (FIGS. 5 to 9) for better understanding of the features in each example. If the vertical length of the permanent magnet 27 at the boundary between N-pole and S-pole is $h_0$ and the vertical length of the same at the both ends of the movable range 1 is $h_1$, the ratio ($h_0/h_1$ preferably ranges from 0.5 to 0.9. In this example, each magnetic pole of the magnet pieces 27*a* to 27*d* is magnetized uniformly and the thickness and the vertical length of the yoke 28 are uniform.

Figure 6:
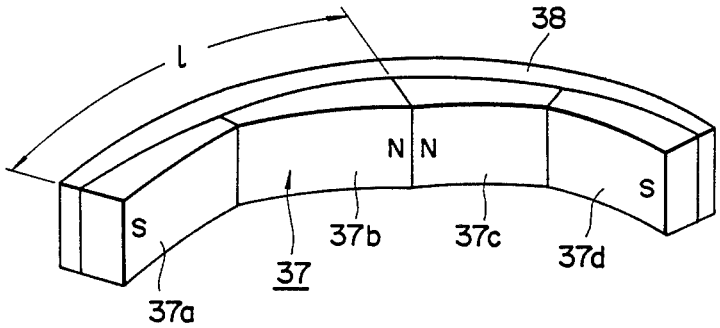

FIG. 6 shows a further example having the same structure as in FIG. 1 except for the form of the permanent magnet 37 and a form of the yoke 38. Namely, in this example, the thickness of the permanent magnet 37 is at its minimum at the boundary between N-pole and S-pole and becomes gradually thicker towards both ends of the movable range 1 the same as in FIG. 1, but its side wall facing the armature 11 is uneven, and the thickness of the, yoke 38 ,is uniform throughout its peripheral length. Accordingly, the total thickness of the permanent magnet 37 and the yoke 38 varies in the periperal direction. In this example, each magnetic pole of the magnet pieces 37*a* to 37*d* is also magnetized uniformly.

Figure 7:
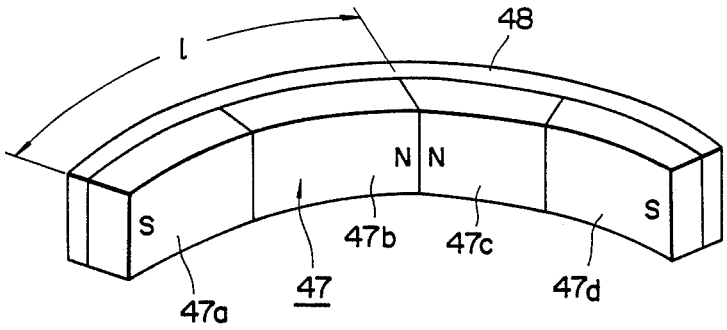
Figure 10:
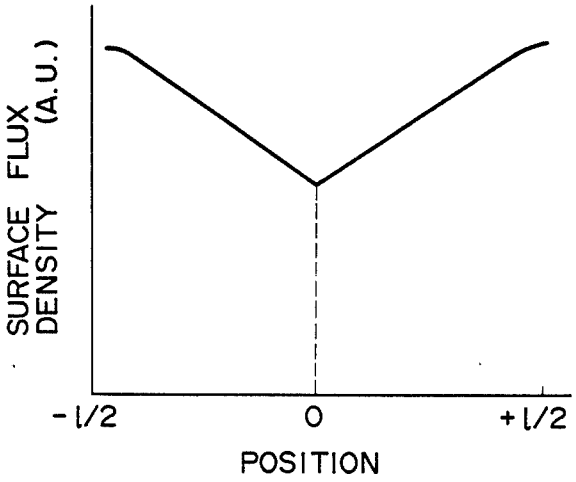
FIG. 10 graph showing the surface flux density of the magnet in the example of the actuator shown in FIG. 7.

FIG. 7 shows a further example having the same structure as in FIG. 1 except that both of the thicknesses of the permanent magnet 47 and the yoke 48 are uniform throughout their peripheral lengths respectively and that each of the magnet pieces 47*a* to 47*d* is so magnetized that the magnitude of the magnetization thereof becomes minimum near the boundary between the magnet pieces 47*a* and 47*b* and near the boundary between magnet pieces 47*c* and 47*d* and gradually increases towards both ends of the movable range 1. Namely, the flux density is controlled by changing the magnitude of the magnetization in the permanent magnet 47. The distribution of the surface flux of the permanent magnet 47 is shown in FIG. 10.

Figure 8:
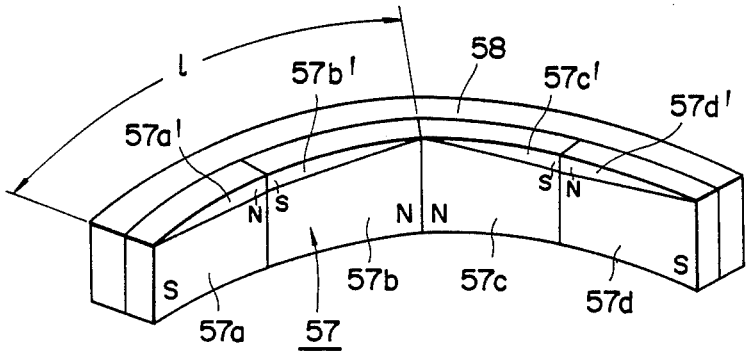

FIG. 8 shows a further example having the same structure as in Fig.1 except that both of the thicknesses of the permanent magnet 57 and the yoke 58 are uniform throughout their peripheral lengths respectively and that each of the magnet pieces is composed of a main magnet piece (57*a*, 57*b*, 57*c*, 57*d*) and an auxiliary magnet piece (57*a*', 57*b*', 57*c*', 57*d*') of opposite polarity. The auxiliary magnet piece is in such a shape that its vertical length becomes gradually larger from the end of the movable region 1 to the boundary between the magnet pieces of opposite polarities.

Figure 9:
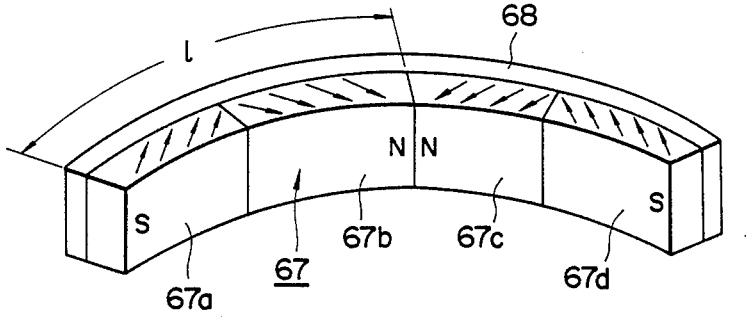
Figure 11:
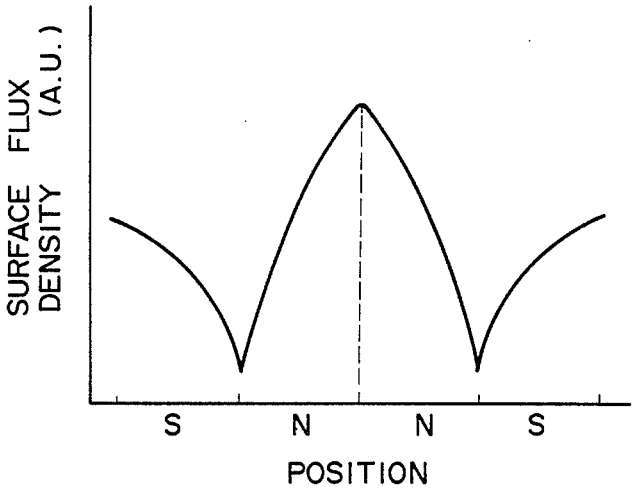
FIG. 11 is a graph showing the surface flux density of the permanent magnet in the example of the actuator shown in FIG. 9.
Figure 12:
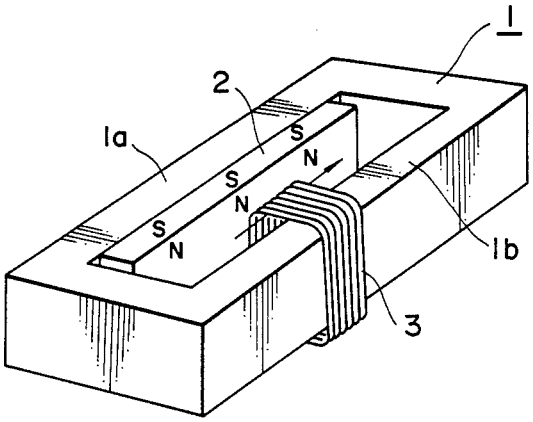
FIG. 12 (PRIOR ART)
FIG. 12 is a perspective view showing a prior art actuator.

FIG. 9 shows a further example having the same structure as in FIG. 1 except that both of the thicknesses of the permanent magnet 67 and the yoke 68 are uniform throughout their peripheral lengths respectively and that each of magnet pieces 67*a*, 67*b*, 67*c* and 67*d* is magnetized so that the magnetization thereof has the component in the peripheral direction, in addition to the component in the radial direction. The magnetization in the magnet pieces 67*a* and 67*b* include the components in the direction perpendicular to the radial direction and the magnetizations of the magnet pieces 67*c* and 67*d* include the components in the direction perpendicular to the radial direction but opposite to the above direction, respectively. The distribution of the surface flux of the permanent magnet 67 is shown in FIG. 11.

With such structures mentioned above by referring to FIGS. 5 to 9, the amount of the magnetic flux generated from the permanent magnets 27, 37, 47, 57 and 67 gradually decreases from both ends of the movable range 1 towards the boundary between N-pole and S-pole, thus obtaining the same effects as in the actuator in FIG. 1.

The present invention has been specifically described by way of examples, but it should be understood that the present invention is not restricted to those examples as have been described above and encompasses various modifications within the scope of the spirit of the present invention.

For example, while the present invention has been described with respect to the actuator employing the rotatable armature provided with two protruding poles, it may employ a rotatable armature having 2n ($n \geqq 2$) of protruding poles. In this case, the permanent magnet is composed of 4n of magnet pieces.

Figure 13:
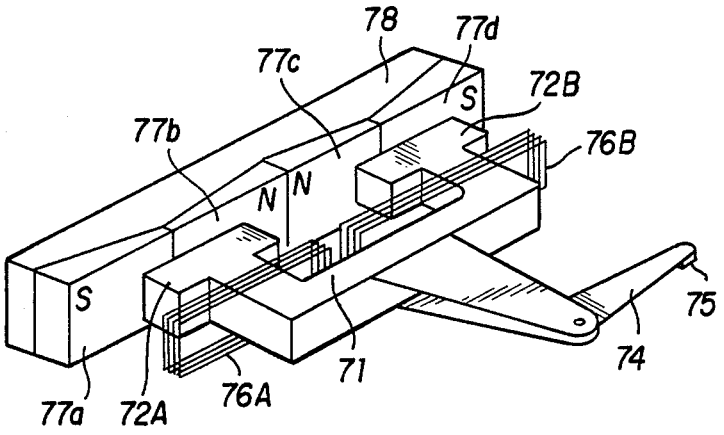
FIGS. 13–15 show other embodiments of the actuator according to the present invention.

Further, while the present invention has been described with respect to so-called rotary type actuator employing the armature rotatable about the axis, the actuator according to the present invention may be manufactured as a so-called linear type actuator by arranging the permanent magnet and the yoke linealy and employing the armature having linearly-disposed protruding poles. This embodiment is shown in FIG. 13.

Figure 14:
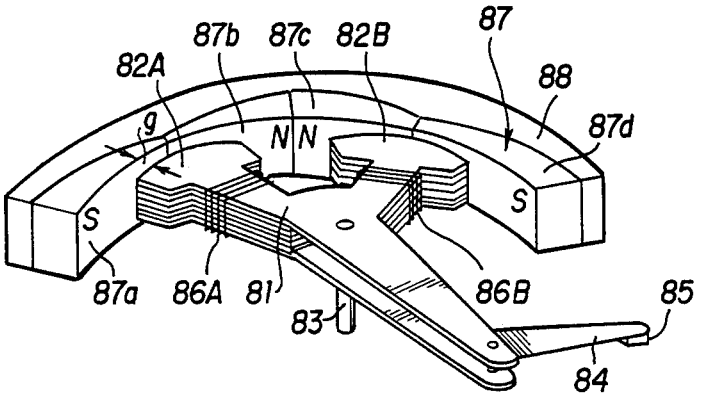
Figure 15:
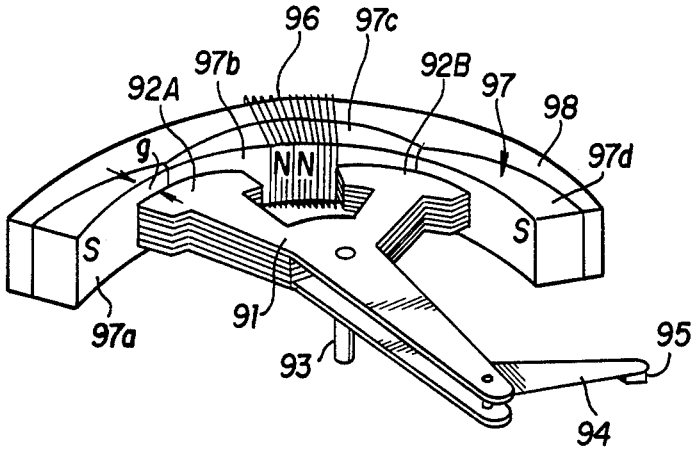

Still further, while the present invention has been described with respect to the actuator in which the coil is not directly wound around the protruding pole, but around each protruding pole with a space therebetween to permit the protruding pole to move independently therefrom, the coil may be wound directly around the protruding pole of the movement therewith, in case where the increase in mass of the armature is allowed to some extent. This embodiment is shown in FIG. 14. Also the coil may be wound around part of the stationary structure comprising the yoke and the permanent magnet, for example, around the portion of such structure, near the boundary between the inner two magnet pieces of same polarity, such as shown in FIG. 15. In this case, the mass of the armature can be reduced and the access time can be shortened, as same in the examples mentioned above.

What is claimed is:

1. An actuator comprising:

an armature having at least one pair of protruding poles and movable so that each of said protruding poles is movable along a predetermined path;

a coil disposed to surround each of said protruding poles and adapted for energizing same such that said protruding poles are energized in opposite polarities to each other;

a stationary yoke extending in the direction parallel to said path; and a permanent magnet composed of plural pairs of juxtaposed magnetic pieces whose magnetic polarities are opposite to each other, said plural pairs of magnetic pieces corresponding in number to the number of said protruding poles and mounted on said yoke in juxtaposition with each other at positions adjacent to the path of the corresponding protruding pole, adjacent two magnetic pieces of adjacent pairs having the same polarity with each other, and said permanent magnet generating such a magnetic flux pattern that the amount thereof gradually decreases from both ends of the path of each protruding pole towards the boundary of the magnetic pieces of the corresponding pair.

2. The actuator as claimed in claim 1, wherein each magnetic pole of the magnetic pieces is magnetized uniformly, the total thickness of the permanent magnet and the yoke is uniform throughout their lengths, and the permanent magnet is formed in a shape such that the thickness thereof gradually decreases from both ends of the path of each protruding pole towards the boundary of the magnetic pieces of the corresponding pair.

3. The actuator as claimed in claim 1, wherein each magnetic pole of the magnetic pieces is magnetized uniformly, and the permanent magnet is formed in a shape such that the vertical length thereof, gradually decreases from both ends of the path of each protruding pole towards the boundary of the magnetic pieces of the corresponding pair.

4. The actuator as claimed in claim 1, wherein each magnetic pole of the magnetic pieces is magnetized uniformly, the thickness of the yoke is uniform throughout its length, and the permanent magnet is formed in a shape such that the thickness thereof gradually decreases from both ends of the path of each protruding pole towards the boundary of the magnetic pieces of the corresponding pair.

5. The actuator as claimed in claim 1, wherein both of the permanent magnet and the yoke are uniform in thickness throughout their lengths respectively, and each of the magnet pieces is magnetized so that the magnitude of the magnetization thereof gradually decreases from both ends of the path of each protruding pole towards the boundary of the magnetic pieces of the corresponding pair.

6. The actuator as claimed in claim 1, wherein both of the permanent magnet and the yoke are uniform in thickness throughout their lengths respectively, each of the magnet pieces is composed of a main magnet piece and an auxiliary magnet piece of opposite polarity, and the auxiliary magnet piece is formed in a shape such that the vertical length thereof gradually increases from both ends of the path of each protruding pole towards the boundary of the magnetic pieces of the corresponding pair.

7. The actuator as claimed in claim 1, wherein both of the permanent magnet and the yoke are uniform in thickness throughout their lengths respectively, and each of the magnet pieces is magnetized so that the magnetization thereof has a component in the direction parallel to the path, in addition to a component in the direction perpendicular to the path.

8. The actuator as claimed in claim 1, wherein the armature is rotatably disposed and the permanent magnet and the yoke are arranged in a circular arc about the rotational axis of the armature.

9. The actuator as claimed in claim 1, wherein the armature is disposed movable along a linear direction and the permanent magnet and the Yoke are arranged in a linear manner.

10. The actuator as claimed in claim 1, wherein the coil is wound around each protruding pole with a space therebetween to permit the protruding pole to move independently therefrom.

11. The actuator as claimed in claim 1, wherein the coil is directly wound around each protruding pole for the movement therewith.

12. The actuator as claimed claim 1, wherein the coil is wound around a part of the yoke-permanent magnet assembly.

* * * * *